US012774135B2

(12) United States Patent
Bourdin

(10) Patent No.: US 12,774,135 B2
(45) Date of Patent: Oct. 27, 2026

(54) DOSING CAP WITH PROTECTION DEVICE

(71) Applicant: SBM DEVELOPPEMENT, Ecully (FR)

(72) Inventor: Frédéric Bourdin, Meyzieu (FR)

(73) Assignee: SBM DEVELOPPEMENT, Ecully (FR)

( * ) Notice: Subject to any disclaimer, the term of this patent is extended or adjusted under 35 U.S.C. 154(b) by 82 days.

(21) Appl. No.: 18/834,923

(22) PCT Filed: Jan. 31, 2023

(86) PCT No.: PCT/FR2023/050122
§ 371 (c)(1),
(2) Date: Jul. 31, 2024

(87) PCT Pub. No.: WO2023/148447
PCT Pub. Date: Aug. 10, 2023

(65) Prior Publication Data

US 2025/0145345 A1 May 8, 2025

(30) Foreign Application Priority Data

Feb. 1, 2022 (FR) ..... 2200876

(51) Int. Cl.
*B65D 47/28* (2006.01)

(52) U.S. Cl.
CPC ..... *B65D 47/283* (2013.01)

(58) Field of Classification Search
CPC ..... G01F 11/288; G01F 11/263; G01F 11/268
See application file for complete search history.

(56) References Cited

U.S. PATENT DOCUMENTS 3,229,866 A * 1/1966 Arbitman ..... G01F 11/288 222/453
3,910,442 A * 10/1975 Gargano ..... B65D 41/06 215/221
4,811,871 A * 3/1989 Wass ..... G01F 13/006 222/548

(Continued)

FOREIGN PATENT DOCUMENTS

CH 715921 A1 * 9/2020 ..... B65D 47/20
EP 0763721 A1 * 3/1997 ..... G01F 11/263

(Continued)

OTHER PUBLICATIONS

May 17, 2023 International Search Report issued in International Patent Application No. PCT/FR2023/050122.

*Primary Examiner* — Michael A Riegelman
(74) *Attorney, Agent, or Firm* — MH2 Technology Law Group, LLP

(57) ABSTRACT

The present invention relates to a dosing cap intended to be mounted on the neck of a container formed of a deformable wall, comprising a dosing chamber provided with a regulating device such as a valve, the dosing cap comprising a protection device located above the valve, said protection device being configured to prevent portions of liquid originating from the valve from being projected, under the action of a pressure exerted on the wall of the container in the absence of means for closing the upper end of the dosing chamber, beyond said upper end of the dosing chamber. The invention also relates to a container provided with such a dosing cap.

15 Claims, 11 Drawing Sheets

(56) References Cited

Figure 1:
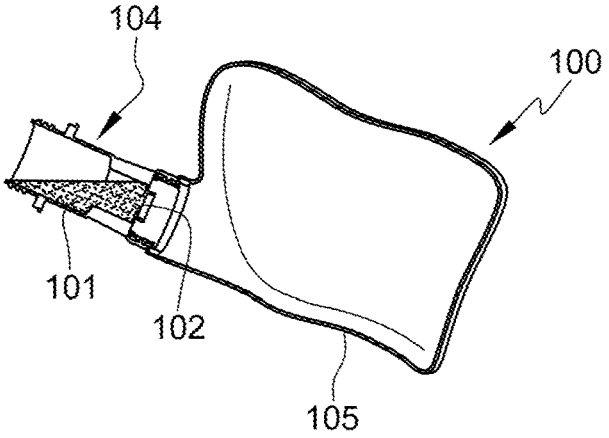

U.S. PATENT DOCUMENTS 4,875,603 A * 10/1989 Weinstein ..... B65D 35/40 222/206
5,067,638 A * 11/1991 Bavaveas ..... B65D 47/283 222/207
5,184,760 A * 2/1993 Weinstein ..... G01F 11/082 222/207
5,261,569 A * 11/1993 Sandwell ..... G01F 11/286 222/158
5,381,930 A * 1/1995 Kalabakas ..... G01F 11/286 222/205
5,584,420 A * 12/1996 Awada ..... G01F 11/263 222/525
5,967,377 A * 10/1999 Glynn ..... B65D 41/26 222/320
7,850,050 B2 * 12/2010 Brown ..... B65D 47/122 222/207
8,528,791 B2 * 9/2013 Fernandez de Mendiola Quintana ..... B65D 47/247 222/213
9,846,066 B2 * 12/2017 Falcon ..... B05B 11/1011
10,099,827 B1 * 10/2018 Levy Sarraf ..... B65D 43/16
10,234,318 B2 * 3/2019 Pater ..... G01F 11/263
10,407,221 B2 * 9/2019 Carrillo Rosillo ..... G01F 19/00
10,422,679 B2 * 9/2019 Geissler ..... G01F 11/288
11,448,542 B2 * 9/2022 Valavala ..... G01F 11/263
11,453,531 B2 * 9/2022 Valavala ..... G01F 11/288
12,358,698 B2 * 7/2025 Prodromou ..... G01F 11/28
2007/0295763 A1 * 12/2007 Brunner ..... B65D 41/0471 222/494
2008/0073377 A1 * 3/2008 Brown ..... B65D 47/122 222/205
2008/0134780 A1 * 6/2008 Micheli ..... G01F 11/288 73/428
2011/0089191 A1 * 4/2011 Altonen ..... G01F 11/286 222/1
2016/0138953 A1 * 5/2016 Greiner-Perth ..... G01F 11/263 222/482
2016/0244222 A1 * 8/2016 Sterling ..... B65D 47/122
2017/0334632 A1 * 11/2017 LaFlamme ..... B65D 35/40
2017/0336234 A1 * 11/2017 Pater ..... G01F 15/005
2018/0111726 A1 * 4/2018 Hoefte ..... G01F 11/288
2018/0274963 A1 * 9/2018 Geissler ..... G01F 11/32
2021/0389166 A1 * 12/2021 Valavala ..... G01F 11/263
2022/0073241 A1 * 3/2022 Valavala ..... B65D 47/2075
2022/0306356 A1 * 9/2022 Prodromou ..... B05B 11/0072
2022/0323303 A1 * 10/2022 Ruggieri ..... A61J 7/0053
2024/0148609 A1 * 5/2024 Battle ..... A61J 1/1418
2025/0145345 A1 * 5/2025 Bourdin ..... G01F 11/288

FOREIGN PATENT DOCUMENTS

EP 1902971 A1 3/2008
EP 2781895 A1 * 9/2014 ..... G01F 11/263
FR 3035645 A3 * 11/2016 ..... G01F 11/006
WO 2005/039998 A1 5/2005
WO WO-2019013428 A1 * 1/2019 ..... B65D 51/28
WO 2020/260856 A1 12/2020

* cited by examiner

DOSING CAP WITH PROTECTION DEVICE

The present invention relates to a dosing cap intended to be mounted on the neck of a container containing a liquid, for example a liquid concentrated in chemical active substance, to be dosed.

For example, in the field of chemical, phytopharmaceutical, pharmaceutical products, detergents, the constitution of an accurate dose of a liquid product may potentially present a risk for the user. Indeed, these products are generally very concentrated and contact thereof with the skin of a user could potentially cause injury such as a burn. When in the presence of such products, regulations require limiting/reducing the risks of potential contact between the product and the user in order to obtain a market authorization.

In the case of phytosanitary products, "self-dosing" type packagings have thus been implemented in order to minimize the manipulations necessary for forming a dose for the products that are the most at risk. Forming the dose could then be done without contact with the user.

Figure 7:
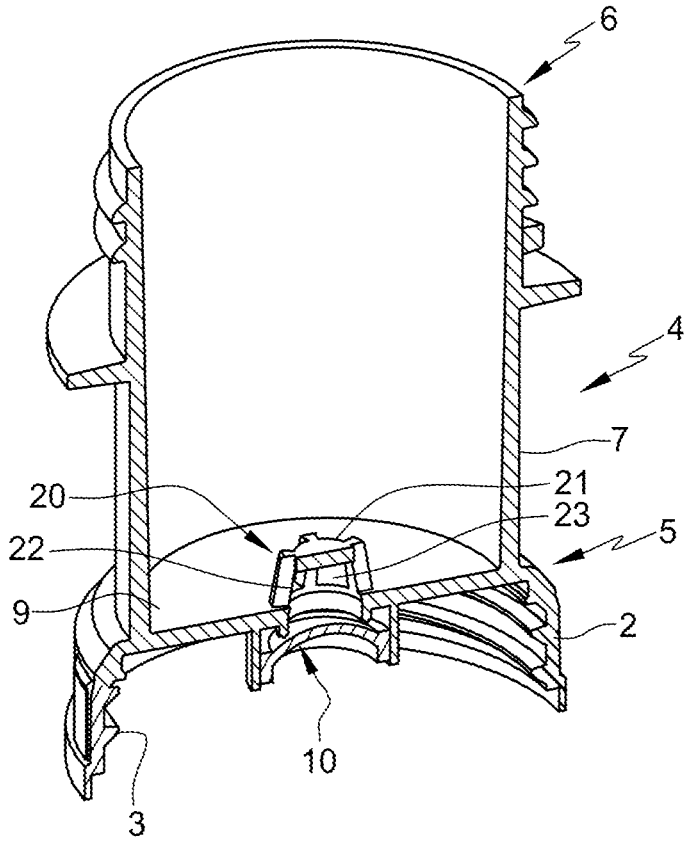
Figure 8:
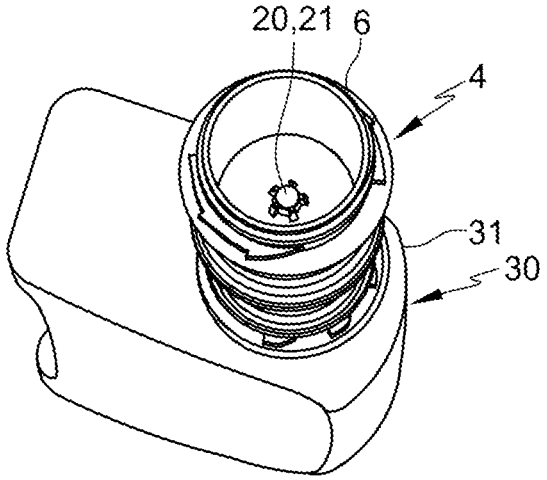

For example, such a packaging is described in the document EP 2 781 895 A1. This document describes a container provided with a dosing cap, whose lower end is sealingly fastened to the neck of the container and whose upper end is provided with a removable closure means. Moreover, the dosing cap comprises a dosing chamber provided with a valve enabling passage of the liquid contained in the container towards the dosing chamber and vice versa only when an external pressure is exerted on the deformable walls of the container. Thus, the user can transfer liquid from the container towards the dosing chamber without having to open the upper end of the dosing cap. The user can also adjust the dosage of the liquid, and in particular retransfer an excess amount of liquid from the dosing chamber towards the container, by flipping over the container and by pressing again on the walls of the latter. Thus, the adjustment of the dose can be done without any risk of the liquid contacting the skin of the user. The dosing cap of this document is of the type with no dipper tube, in other words, it does not comprise a tube extending from its lower end to the inside of the container, for example to the bottom of the container. Thus, with this type of dosing cap, the adjustment of the dose in the dosing chamber is done with the container being closed, by flipping over the container as many times as necessary and by exerting successive pressures on the walls of the container, until the desired dose is obtained, as shown in FIGS. 7 and 8 of this document. Such a dose adjustment method is not possible with a dosing cap that comprises a dipper tube. Indeed, when a container provided with a dosing cap with a dipper tube is in the flipped over position, the free end of the dipper tube is generally in a space of the container free of liquid, and exerting a pressure on the container does not allow transferring liquid from the container towards the dosing chamber of the dosing cap.

Nonetheless, once the liquid has been dosed, the user of a packaging of the prior art as described hereinabove must open the upper end of the dosing cap in order to transfer the dosed liquid into a final container for use of the liquid in the desired application. For example, this final container may be a sprayer if it is in the case of a phytosanitary product. Alternatively, this final container may be a bucket in the case of a detergent.

This final step of transferring the dosed liquid towards the final container should necessarily be done with the upper end of the dosing cap being open. Consequently, this operation presents risks. Indeed, the operating principle of these packagings is based on the deformation of the walls of the container by the hand of the user to create a pressure differential between the container and the dosing cap, this pressure differential causing opening of the valve of the dosing chamber and thus enabling passage of the liquid from the container towards the dosing chamber. Yet, during the step of final transfer of the dosed liquid towards a final container, the user holds the container in one hand in order to pour the dosed liquid into the final container. When the user places the container again on a planar surface, it might then happen that he/she exerts a pressure on the walls of the container with his hand and that liquid remaining in the bottom of the dosing cap is projected through the dosing chamber towards the user or its environment.

Figure 2:
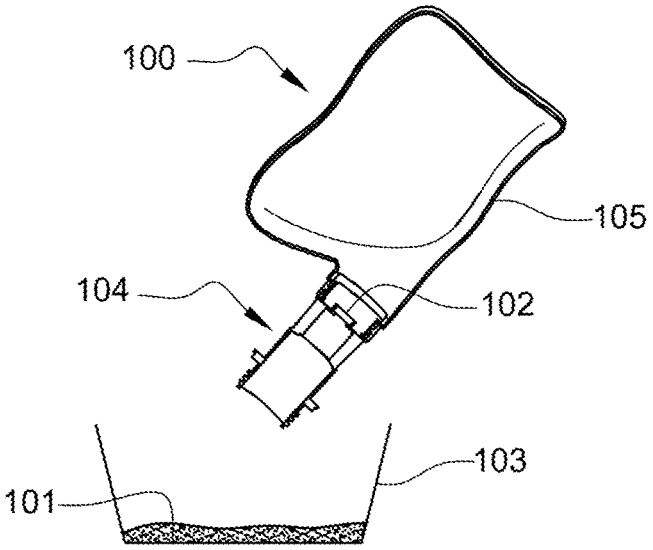
Figure 3:
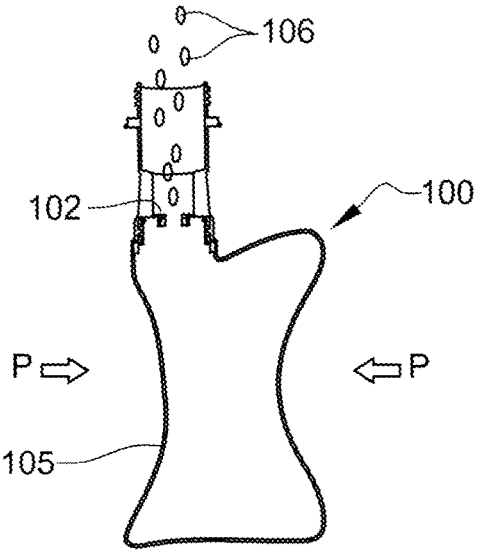

Enclosed FIGS. 1 to 3 illustrate this phenomenon with a conventional packaging 100. FIGS. 1 and 2 show a conventional packaging 100 once the dose of liquid 101 to be dosed has been adjusted and the upper closure means (not shown) of the dosing cap 104 has been removed in order to proceed with the phase of final transfer of the dosed liquid 101 towards a final container 103. In the absence of any stress exerted on the walls of the packaging 100, the valve 102 separating the dosing cap 104 from the inside of the container 105 is closed. In FIG. 2, all of the dosed liquid 101 has been transferred into the final container 103. It might then happen that by poor handling, when he/she places the container 105 before having had the time to close the upper end of the dosing cap 104, the user presses slightly too much on the wall of the container 105, as shown by the arrows P in FIG. 3. In such a case, the valve 102 can open under the effect of the pressure present inside the container 105, and drops 106 of the liquid that have remained at the bottom of the dosing cap 104 may be projected towards the user or its environment.

Moreover, the valves used in the dosing chambers of these types of packaging are often valves made of elastomers. These elastomeric valves generally have a high deformability which means that, as soon as enough pressure differential is reached between the container and the dosing cap, these valves deform and open abruptly. This sudden opening could also contribute to causing projections of the liquid that would have remained at the surface of the valve, following a previous handling.

Thus, under normal conditions of use as described hereinabove, by an informed user, the risk that projections of the concentrated liquid contact the skin or the eyes of the user during this final step is not negligible.

Yet, it might also happen, for various reasons, that the packaging is not used properly, or is used by an unexperienced consumer. For example, it might happen that a user omits reading the instructions of use beforehand and seeks to understand the operation of the packaging after having opened the upper end of the dosing cap; in such a case, handling of the container with the cap being open by the user involves significant risks of projection of the concentrated liquid from the dosing cap towards the environment or towards the user.

Another situation to be taken into account is the situation where a user would omit closing the upper end of the dosing cap after having poured the dosed liquid into the final container. In such a case, a child, or a person not informed on the hazard of the liquid contained in the container, could manipulate the packaging with the cap being open and expose himself/herself to risks of burning by contact with the concentrated liquid, or worse by ingestion of this liquid.

Hence, there is still a need for a dosing cap of the type with no dipper tube, which not only would allow performing an accurate dosing of a concentrated liquid without any risk of contact with the user by successive flip-overs of the closed container as described hereinabove, but which would also allow performing the operation of final transfer of the dosed liquid towards a final container, with the upper end of the dosing cap being open, under optimum safety conditions. Such a dosing cap would also ideally allow preventing any risk of contact with the user when it would be handled with its upper end opened by an unexperienced user.

The present invention aims to address this need by proposing a dosing cap preventing the risk of spraying concentrated liquid after the phase of final transfer of the dosed liquid towards the final container.

The present invention relates to a dosing cap with no dipper tube, intended to be mounted on the neck of a container formed of a wall able to be deformed under the effect of an external pressure, said wall defining an inside of said container, in which a liquid is contained, said dosing cap comprising:

- Means for mounting the dosing cap to said neck, said mounting means being configured to ensure a hermetic connection of the dosing cap to the neck,
- A dosing chamber comprising a lower end and an upper end,
  - Said lower end being intended to be arranged opposite the liquid contained inside said container when the dosing cap is mounted on said neck, said lower end comprising an inner wall separating the dosing chamber from the inside of the container, said inner wall being provided with a regulating device configured to block the passage of said liquid from the inside of the container towards the dosing chamber and from the dosing chamber towards the inside of the container under the simple effect of gravity, in the absence of any stress exerted on the wall of the container, and to enable passage of the liquid and gas from the inside of the container towards the dosing chamber and from the dosing chamber towards the container under the action of a determined pressure exerted on the wall of the container,
  - Said upper end being open,
- Means for closing the upper end of the dosing chamber, adapted to be removably fastened on said upper end and configured to ensure a hermetic closure of said upper end with respect to the external environment when they are fastened on said upper end,
- said dosing cap being characterized in that it further comprises:
- a protection device located in the dosing chamber above the regulating device, said protection device being configured to prevent liquid portions originating from a lower portion of the dosing chamber or of the regulating device from being projected, under the action of a pressure exerted on the wall of the container in the absence of the closure means of the upper end of the dosing chamber, beyond said upper end of the dosing chamber.

The dosing cap according to the invention has no dipper tube. When the dosing cap according to the invention is mounted on the neck of the container and the upper end of the dosing chamber is hermetically closed by said closure means, the adjustment of the desired dose in the dosing chamber is done by successive flip-overs of the container and pressures exerted on the walls of the container as described hereinabove.

Thanks to its protection device located above the regulating device, the dosing cap according to the invention allows keeping within the dosing chamber, and more particularly as close as possible to the inner wall of this chamber, any portion of liquid remaining at the bottom of the dosing chamber, in a lower portion of the latter, and which might be projected out of the dosing chamber after the phase of final transfer of the dosed liquid towards the final container, for example when the user places the container on a planar surface before having closed the upper end of the dosing cap. With the dosing cap according to the invention, if, by poor manipulation, the user presses too strongly on the walls of the container at this time, the liquid that would be projected by the opening effect of the regulating device under the effect of this pressure would be stopped by the protection device before being able to come out of the dosing chamber. Thus, contact with the user would be avoided.

In one embodiment, the mounting means are configured to further ensure an irreversible connection of the dosing cap to the neck. In such a case, the dosing chamber being permanently fastened to the container, the risks of the liquid flowing over an outer portion of the container at the junction between the dosing chamber and the neck of the container are avoided. Thus, the risks of contact between the liquid and the skin of the user are considerably minimized.

The dosing cap according to the invention is intended to be mounted on the neck of a container containing the liquid to be dosed.

Thus, the present invention also relates to a container comprising a neck and formed of a wall able to be deformed under the effect of an external pressure, said wall defining an inside of said container, in which a liquid is contained, characterized in that a dosing cap as described hereinafter is mounted on said neck according to a hermetic, and preferably irreversible, connection, by means of said mounting means.

The container is generally formed of a flexible wall, able to be deformed under the effect of an external pressure. The external pressure considered herein is generally a manual pressure: for example, the wall of the container may be compressed by a hand of the user. Moreover, the wall forming the container is also generally able to recover its initial shape as soon as the pressure exerted thereon is relieved, in other words in a stress-free configuration. Such containers are known to a person skilled in the art. Such containers are generally formed of extrusion or injection of polymeric compounds such as high-density polyethylene (HDPE), polypropylene (PP), polylactic acid (PLA), polyamide (PA), polyether terephthalate (PET). The container may be monolayer or multilayer.

The product, for example a phytosanitary product, contained in the container is in the form of a liquid. Phytosanitary products are generally classified as hazardous goods. Thus, as a liquid that could be contained in the container that could be used with the dosing cap according to the invention, mention may be made of toxic materials, corrosive materials, and generally any liquid product that is hazardous to humans and their environment, in the event of direct contact, like, for example, detergents, bleach, concentrated laundry detergents, pharmaceutical products, etc. In particular, the liquid contained in the container may be in the form of a concentrated liquid, an accurate dose of which should be determined which should then be diluted in order to use it in the desired application.

In the present application, by "upper end or portion", it should be understood the end or the portion of a part located upwards in a rest configuration of said part, and by "lower end or portion", the end or the portion of a part located downwards in a rest configuration of said part. Thus, the adjectives "upper" and "lower" applied to a portion of the dosing cap according to the invention respectively designate an upward portion and a downward portion, when the dosing cap is mounted on the neck of the container and the container is standing in a vertical position, the neck being directed upwards.

In the present application, the expressions "in the distal direction" or "distally" mean in the direction of discharge of the liquid from the container towards the outside of the container, and the expressions "in the proximal direction" or "proximally" mean in the direction of return of the liquid towards the inside of the container.

The dosing cap according to the invention comprises means for mounting the dosing cap to the neck of the container. The mounting means are configured to ensure a hermetic, and preferably irreversible, connection of the dosing cap to the neck.

In the present application, by "hermetic connection" or "hermetic closure", it should be understood a connection or closure having no leakage, in other words no direct connection between the interior and the exterior of the device (i.e. dosing cap+container) under normal conditions of use of temperature and pressure, that is to say for example for a maximum overpressure of +/−500 mbar with respect to the atmospheric pressure and for a temperature ranging from −10° C. at 50° C. Thus, no fluid, liquid or gas, could penetrate into the container or come out of the container via a direct connection between the inside and the outside of the container, once the dosing cap is mounted on the neck of the container with the upper end of the dosing chamber being hermetically closed. For example, such a hermetic connection may be achieved by incorporating a sealing gasket at the level of the dosing cap at the interface with the neck of the container, we will then talk about a "jointed dosing cap". Another embodiment would consist of a tight mechanical design between the dosing cap and the neck of the container which would not tolerate any leakage, and therefore with no sealing gasket. We would then talk about a "self-joining dosing cap".

Moreover, by irreversible connection, it should herein be understood that, once the dosing cap is mounted on the neck of the container, it can no longer be removed therefrom.

In the case where the neck has an external thread, the mounting means may be in the form of a thread adapted to cooperate with the external thread of the neck. Thus, the dosing cap could be screwed onto the neck of the container. Moreover, the thread may further comprise a stop making unscrewing of the dosing cap impossible and therefore screwing irreversible. Thus, the mounting means may be configured to make disassembly thereof impossible for a child, like in a CRC (child resistant connection) type cap. Alternatively, the mounting means may be in the form of snap-fitting a dosing cap onto the neck of the container.

The dosing cap according to the invention also comprises a dosing chamber. The dosing chamber comprises a lower end and an upper end.

The dosing chamber being intended to allow forming the desired dose of the liquid, it is preferably formed of walls enabling the user to see the inside of this chamber, in particular allowing seeing the level of liquid present in the dosing chamber. Thus, the dosing chamber is preferably formed of transparent or translucent walls. For example, the dosing chamber may be formed of a cylindrical wall, preferably transparent. Alternatively, the dosing chamber may be formed of a translucent wall made of polyethylene: for example, a translucent wall made of polyethylene may be treated by fluorination in order to increase its barrier properties and thus offers enhanced properties in terms of safety.

In one embodiment, the dosing chamber is delimited by a transparent or translucent cylindrical wall provided with graduations for assisting in dosing.

The lower end of the dosing chamber is intended to be arranged opposite the liquid contained inside the container when the dosing cap is mounted on the neck. The lower end of the dosing chamber comprises an inner wall separating the dosing chamber from the inside of the container, said inner wall being provided with a regulating device configured to block passage of said liquid from the inside of the container towards the dosing chamber and from the dosing chamber towards the inside of the container under the simple effect of gravity, in the absence of any stress exerted on the wall of the container, and to enable passage of the liquid and gas from the inside of the container towards the dosing chamber and from the dosing chamber towards the container under the action of a determined pressure exerted on the wall of the container. Thus, the regulating device enables transfer of the liquid in both directions, in other words from the container towards the dosing chamber on the one hand, and from the dosing chamber towards the container on the other hand, from the time when a pressure differential exists between the container and the dosing chamber. Thus, when the hermetically closed container is flipped over (dosing chamber downwards), but no pressure is exerted on the walls of the container, the regulating device blocks passage of the liquid from the inside of the container towards the dosing chamber. On the other hand, when the hermetically closed container is flipped over and a pressure is exerted on the walls of the container, the regulating device enables passage of the liquid from the inside of the container towards the dosing chamber. Similarly, when the hermetically closed container is in the upright position (the dosing chamber being upward) but no pressure is exerted on the walls of the container, the regulating device blocks passage of the liquid from the dosing chamber towards the inside of the container. On the other hand, when the hermetically closed container is in the upright position and a pressure is exerted on the walls of the container, the regulating device enables passage of the liquid from the dosing chamber towards the inside of the container.

Thus, the inner wall separating the dosing chamber from the inside of the container generally forms a liquid barrier, the latter could nonetheless pass from the inside of the container towards the dosing chamber or vice versa from the dosing chamber towards the inside of the container throughout the regulating device when a pressure is applied on the wall of the container. For example, the inner wall separating the dosing chamber from the inside of the container may be a transverse inner wall.

The regulating device also enables air to pass from the inside of the container towards the dosing chamber and vice versa during the phases of adjustment of the dose of liquid, when the dosing cap is closed.

In particular, in the dosing cap according to the invention, the inner wall separating the dosing chamber from the inside of the container comprises no dipper tube, and the regulating device is not connected to a dipper tube. Thus, it is possible to adjust the dose by flipping over the container and by exerting a pressure on the walls of the container in order to transfer a portion of liquid from the inside of the container into the dosing chamber via the regulating device.

The upper end of the dosing chamber is open, in particular to enable the discharge of the liquid that has been dosed.

This upper end should also be able to be closed, in particular during the operation of adjusting the liquid dose.

Thus, the dosing cap according to the invention also comprises means for closing the upper end of the dosing chamber. These closure means are configured to ensure a reversible hermetic closure of the upper end of the dosing chamber with respect to the external environment. To the extent that the lower end of the dosing chamber could, under some conditions, let liquid pass from the inside of the container towards the dosing chamber, the closure means of the upper end of the dosing chamber form the closure means of the container when the dosing cap is mounted on the neck of the container, in other words the "container-dosing cap" assembly. In particular, the closure means of the upper end of the dosing chamber allow hermetically closing the "container-dosing cap" assembly with respect to the external environment, irrespective of the configuration of the wall forming the container, i.e. in a rest configuration of said wall, that is to say with no stresses, or in a configuration in which an external pressure is applied in order to deform said wall.

The dosing cap according to the invention, when it is mounted on the neck of said container, thus allows avoiding the risks of dispersion in the immediate environment of the container of the liquid, whether in liquid form (for example in the case of tilting of the container) or in vapor form (for example between two uses). Indeed, some constituents of phytosanitary liquids (active or formulating liquids) are potentially volatile at room temperature (for example: Volatile Organic Compound). It is necessary to guarantee sealing and safety over periods of two to three years in ambient storage conditions for volatile liquids at room temperature, like for example solvents. The dosing cap according to the invention allows forming a container-dosing cap assembly that remain secure over several years, safe, in particular free of any device likely to set the inside of the dosing chamber or of the container into direct connection with the outside under normal conditions of temperature and pressure.

Moreover, the closure means of the upper end of the dosing chamber enable a reversible closure of this end in order to be able to enable opening of the dosing chamber towards the outside, once the liquid is dosed and it is desired to transfer it for use, for example to form a dilute solution for the treatment of a plant.

Thus, these closure means may consist of a cover which can be screwed or clipped onto the distal end of the dosing chamber. In one embodiment, the means for closing the upper end of the dosing chamber are configured to make opening thereof impossible for a child, such as CRC (child resistant connection) type caps.

Like for the above-described mounting means, by hermetic closure, it should herein be understood that, once the upper end of the dosing chamber has been closed, no direct connection between the inside and the outside of the device (i.e. dosing cap+container) exists under normal conditions of use of temperature and pressure, that is to say for example for a maximum overpressure of +/−500 mbar with respect to atmospheric pressure and for a temperature ranging −10° C. to 50° C.

In one embodiment, the protection device comprises a transverse wall portion, located opposite the regulating device and distally with respect to this regulating device, and a load-bearing structure connecting said transverse wall portion to said inner wall, said load-bearing structure comprising at least one recess. The transverse wall portion may have any shape, for example round, square, triangular and may have dimensions similar to or slightly larger than the dimensions of the opening of the regulating device when it is in open position. Thus, the transverse wall portion generally has dimensions much smaller than the diameter of the dosing chamber when the latter is cylindrical. Because of its location, the transverse wall portion allows stopping any drop or portion of liquid originating from the lower portion of the dosing chamber or from the regulating device and projected towards the upper portion of the chamber after the final transfer phase, before the upper end of the dosing chamber having been closed by the user. The drops projected obliquely, that is to say according to a direction forming an angle with the distal direction, are stopped by the lateral wall of the dosing chamber. Thus, the phase subsequent to the transfer of the dosed liquid into the final container, before the upper end of the dosing cap being closed, is safe. The risk of drops of liquid being projected onto the user is very low.

Moreover, thanks to the presence of the recess, the liquid passing through the regulating device originating from the container can flow and fill the dosing chamber during the prior dosing operations, when the upper end of the dosing chamber is closed. Thus, the protection device enables flow of the liquid from the inside of the container towards the dosing chamber, and vice versa.

In one embodiment, the load-bearing structure comprises a plurality of recesses, said recesses being separated from one another by a plurality of pillars extending from said transverse wall portion to said inner wall, distributed along the perimeter of said transverse wall portion. A plurality of recesses enables a fluidified flow of the liquid in the dosing chamber. For example, the pillars may be evenly spaced along the perimeter of said transverse wall portion.

In one embodiment, said recess(es) is/are confined in a determined angular section of the periphery of the load-bearing structure, for example in an angular section ranging from 0 to 180° of the periphery of the load-bearing structure. For example, the transverse wall portion may be round, and the recesses are confined in the load-bearing structure over half or over one quarter of the circumference of the transverse wall portion. This embodiment allows ensuring that the drops of liquid that pass from the inside of the container towards the dosing chamber during the adjustment of the dose or the drops of liquid likely to be projected after the phase of final transfer are confined in a specific angular section of the dosing chamber. It is then possible to provide graduations for assisting in dosing on the transparent or translucent wall of the dosing chamber without the risk of these being soiled by the projected drops, by locating these graduations opposite the determined angular section in which the recesses are confined. Thus, in one embodiment, the dosing chamber being delimited by a transparent or translucent cylindrical wall provided with graduations for assisting in dosing, said graduations are located in an angular section of the transparent cylindrical wall diametrically opposite to said determined angular section.

In one embodiment, at least one of said recesses extends distally from said inner wall. The fact that at least one recess extends distally from the inner wall of the dosing chamber allows ensuring complete emptying of the dosing chamber towards the inside of the container where appropriate. Indeed, thanks to the presence of a recess extending distally from the inner wall, all of the liquid remaining at the level of this inner wall, which forms the lower end of the dosing chamber, can be evacuated towards the inside of the container via the regulating device present on said inner wall. In one embodiment, several ones of said recesses extend from the inner wall.

In one embodiment, the load-bearing structure comprises a plurality of recesses, said recesses being separated from one another by a plurality of pillars extending from said transverse wall portion to said inner wall, distributed along the perimeter of said transverse wall portion. Such an embodiment, in a flipped over position of the dosing cap, allows time for the user having inadvertently pressed on the container with the neck directed downwards in order to react and prevent a leakage of product towards the external environment, by replacing the container upright for example. In such a case, for example, a viscous liquid could partially be retained by the aforementioned proximal peripheral rim and/or diverted towards the walls of the dosing chamber by the recesses.

In one embodiment, said protection device is configured to store an amount of liquid ranging from 1 ml to 5 ml in a flipped over position of the dosing cap. For example, the transverse wall portion may be provided with a proximal peripheral rim able to contain said amount of liquid on a proximal face of said transverse wall portion. Thus, in the flipped over position of the dosing cap, in other words with the neck of the container directed downwards, a small amount of liquid can be stored in the protection device. This allows keeping a small amount of liquid if the container were to be flipped over accidentally with the cap being open. Such a storage area could also prove to be useful in the case of a regulating device having a sealing defect.

In one embodiment, said protection device is configured to store an amount of liquid ranging from 1 ml to 5 ml in a flipped over position of the dosing cap and the recesses are confined in a determined angular section of the periphery of the load-bearing structure as described hereinabove.

The regulating device may be in different forms depending on the viscosity, the density and/or the chemical aggressiveness of the liquid contained in the container.

Thus, in one embodiment, the regulating device may comprise a valve. Preferably, the valve is a two-way valve, and it enables the liquid to pass from the inside of the container towards the dosing chamber and vice versa. In one embodiment, the regulating device comprises a valve made of elastomer.

Alternatively or in combination, the regulating device may for example comprise one or several hole(s) having a diameter ranging from 0.1 to 8 mm, formed in the inner wall separating the dosing chamber from the inside of the container.

In another embodiment, the regulating device comprises a sealing gasket equipped with a valve system, that is to say a gasket which, besides its sealing function on its periphery, also offers a function of regulating the liquids throughout cutting(s) at its center.

Irrespective of the used regulating device, after transfer of the dosed liquid into the final container, drops of liquids can remain sticked to the wall of the dosing chamber and by gravity fall back towards the lower end of the dosing chamber, on the regulating device inter alia. The protection device of the dosing cap according to the invention allows preventing such drops of liquid thus present in the lower portion of the dosing chamber from being projected beyond the upper end of the dosing chamber if the user inadvertently exert a pressure on the walls of the container before having closed the dosing cap.

Figure 4:
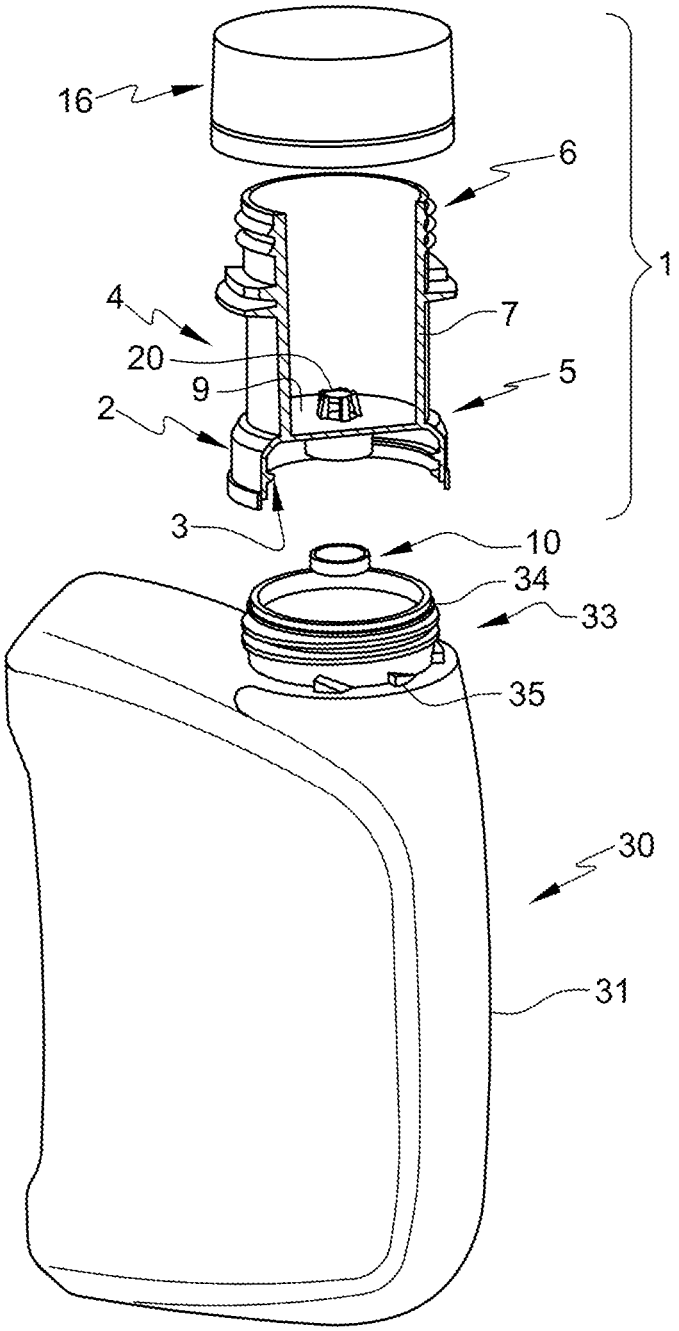
Figure 5:
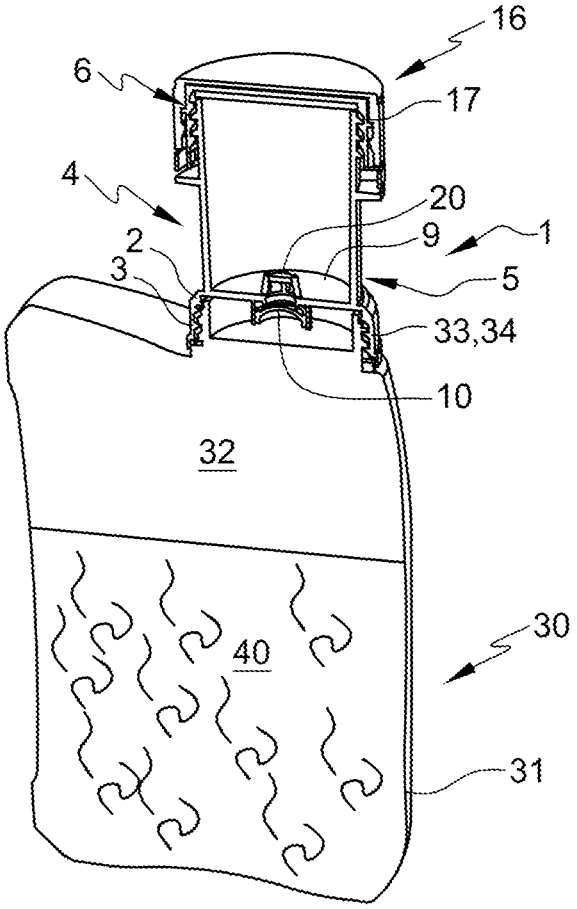
Figure 6A:
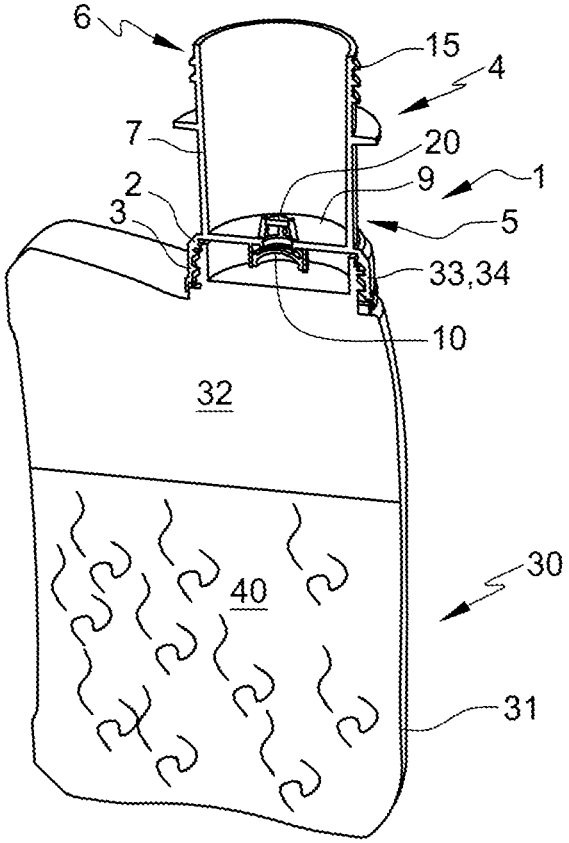
Figure 6B:
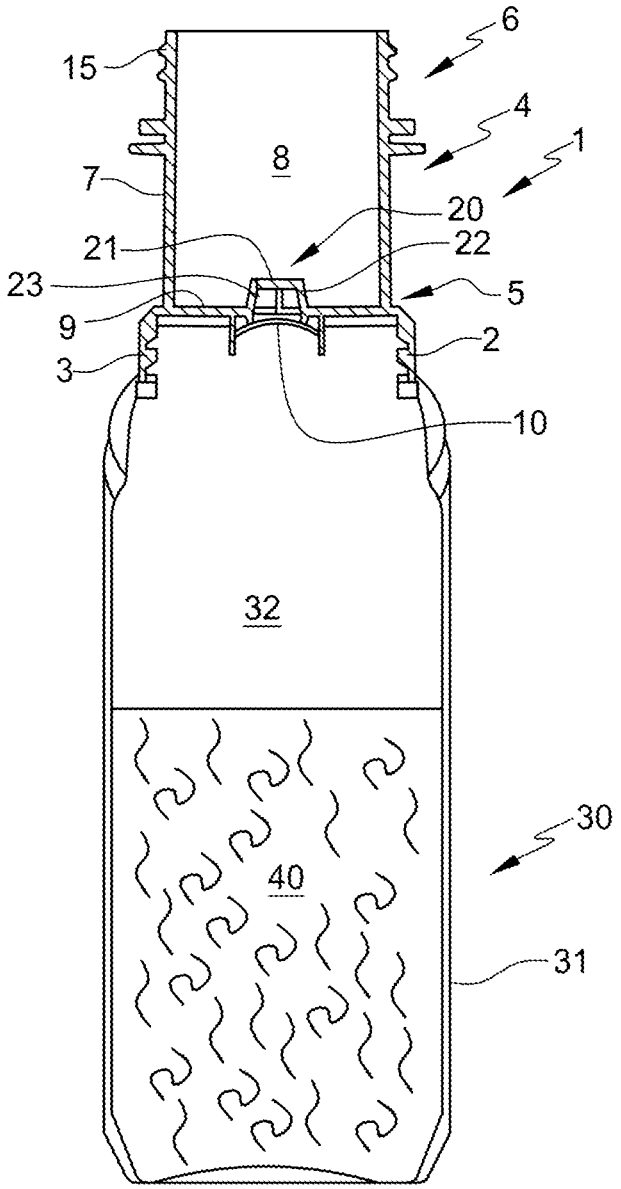
Figure 9:
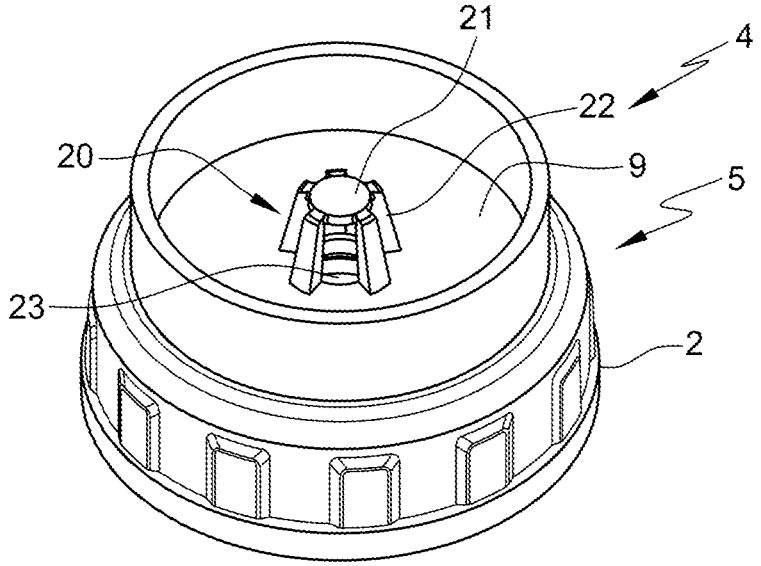
Figure 10:
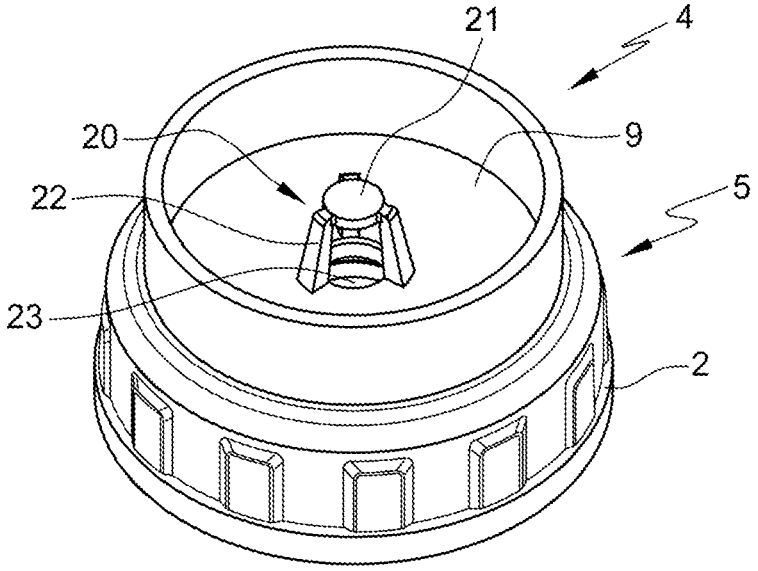
Figure 11:
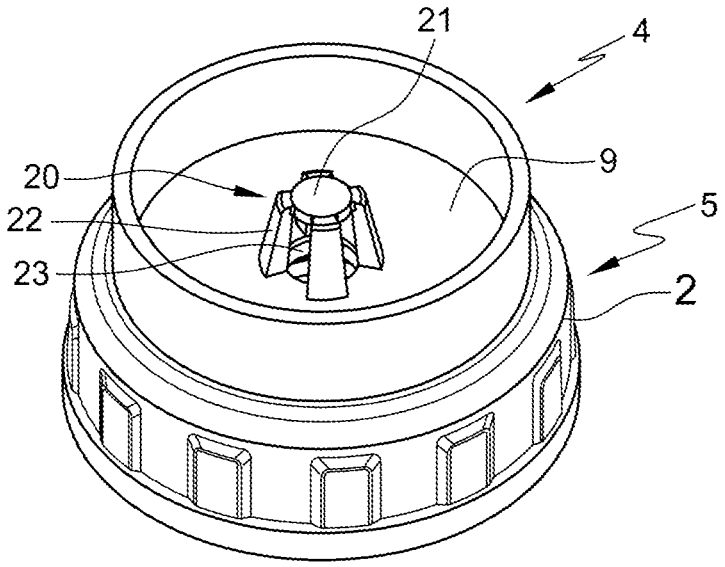
Figure 12:
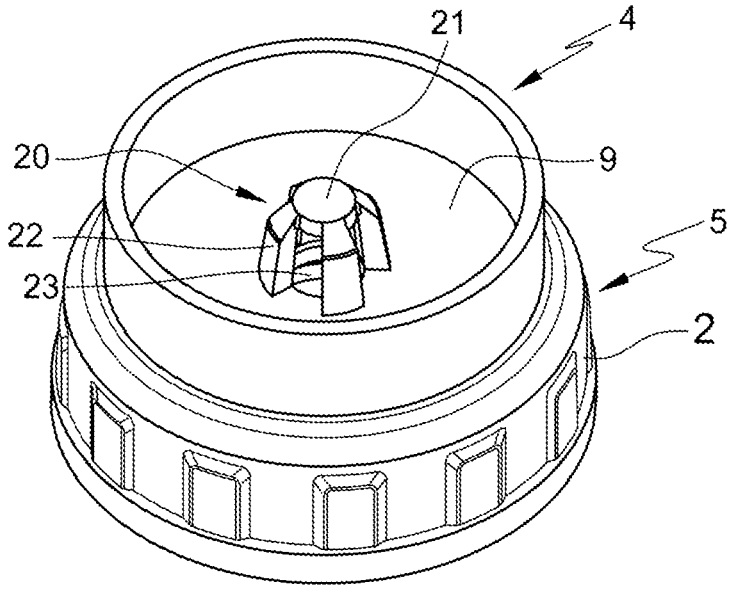
Figure 13:
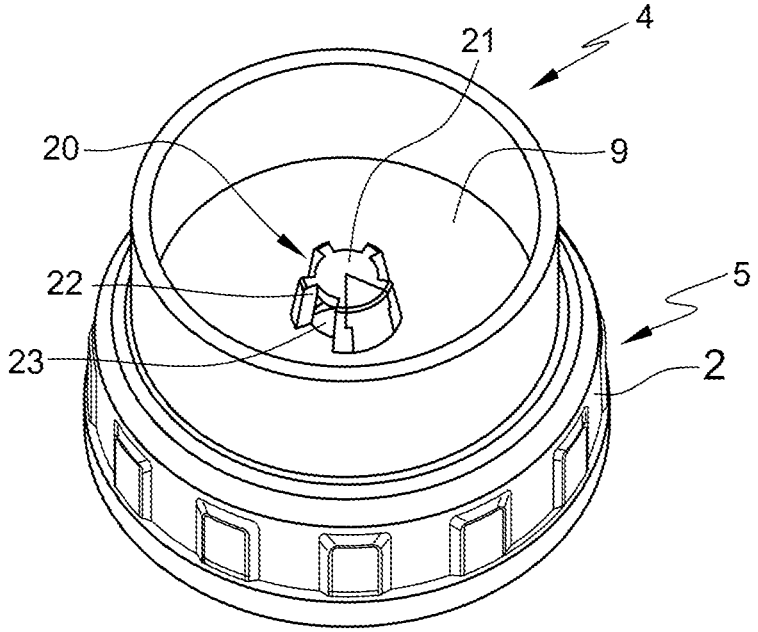
Figure 14:
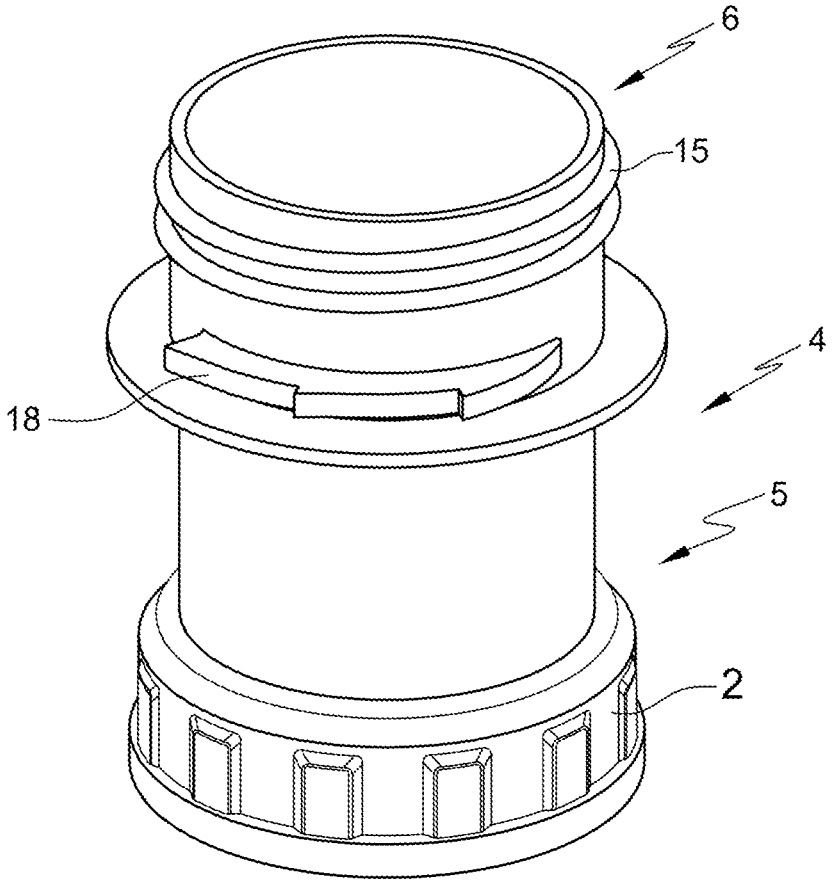
Figure 15:
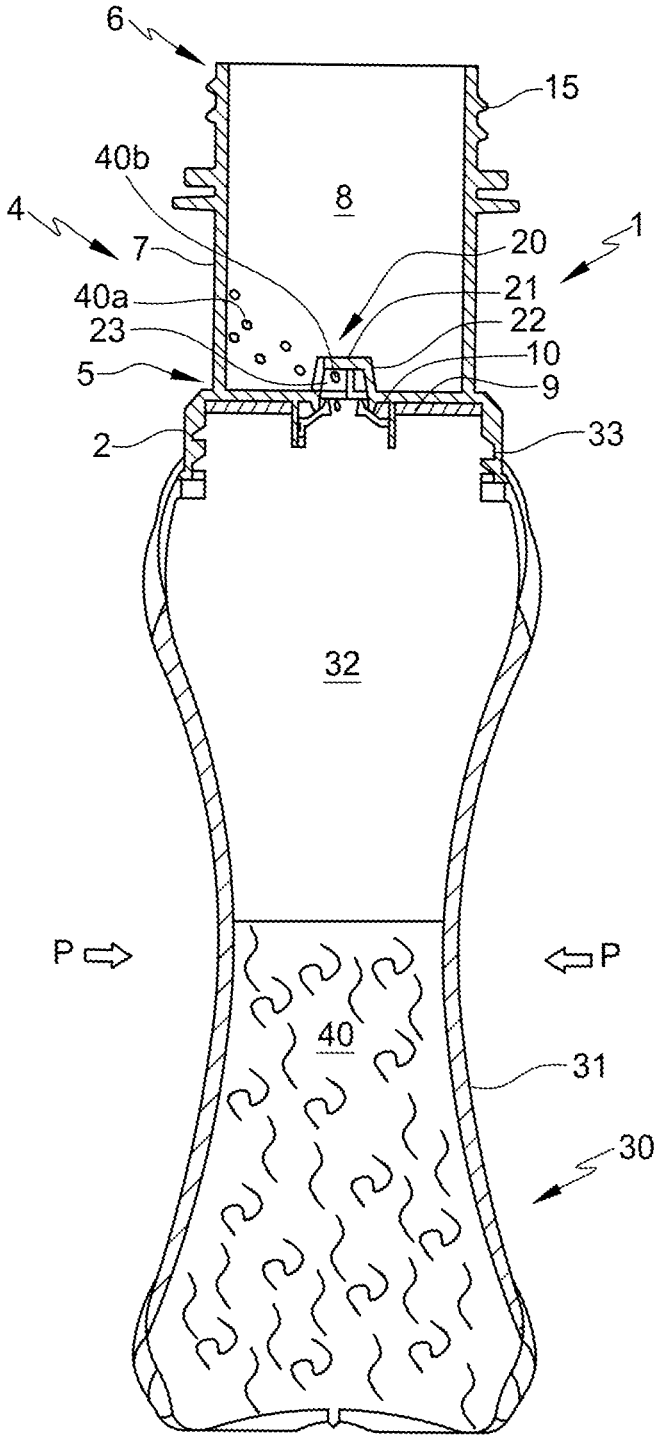
Figure 16:
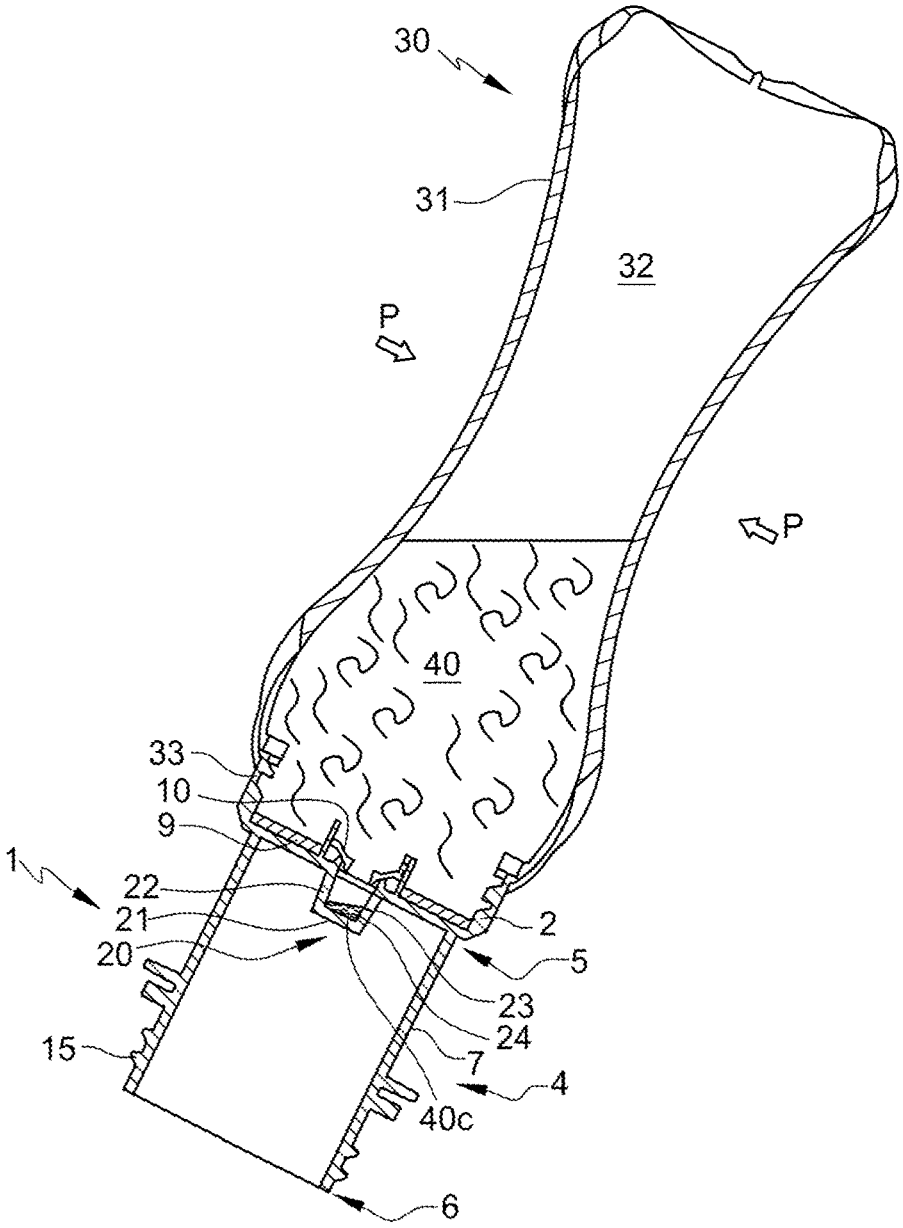
Figure 17:
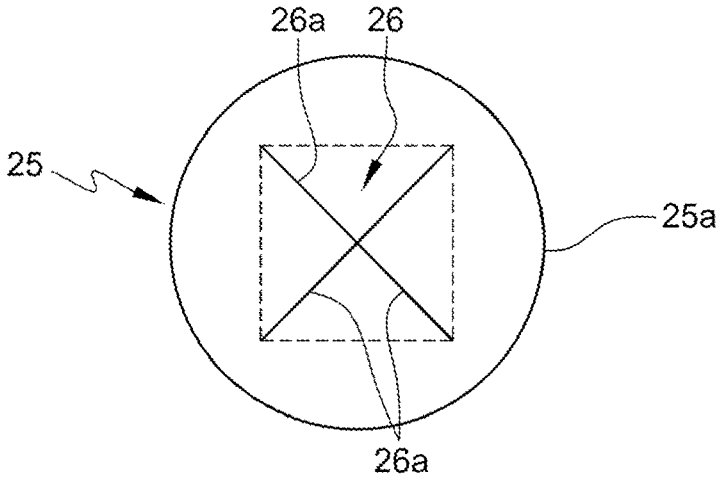

The present invention will appear better from the detailed description hereinafter and from the figures wherein:

FIG. 1 is a sectional view of a container and a dosing cap of the prior art before the phase of final transfer of the dosed liquid, FIG. 2 is a sectional view of the container and of the dosing cap of FIG. 1 at the end of transfer of the dosed liquid into a final container, FIG. 3 is a sectional view of the container and of the dosing cap of FIGS. 1 and 2 upon poor handling of the container after transfer of the dosed liquid, FIG. 4 is an exploded and partially sectional perspective view of a container and of a dosing cap according to the invention when the dosing cap is closed, FIG. 5 is a sectional view of the container and of the dosing cap of FIG. 4 when the dosing cap is closed, FIG. 6A is a sectional view of the container and of the dosing cap of FIG. 4 when the dosing cap is open, FIG. 6B is a sectional view perpendicular to FIG. 6A, FIG. 7 is a sectional view of the dosing cap of FIG. 4 when open, FIG. 8 is a top view of the dosing cap of FIG. 4 on the container, and open, FIG. 9 is a perspective view of the protection device of the dosing cap of FIG. 4, FIG. 10 is a perspective view of another embodiment of a protection device of the dosing cap according to the invention, FIG. 11 is a perspective view of another embodiment of a protection device of the dosing cap according to the invention, FIG. 12 is a perspective view of another embodiment of a protection device of the dosing cap according to the invention, FIG. 13 is a perspective view of another embodiment of a protection device of the dosing cap according to the invention, FIG. 14 is a perspective view of the dosing cap of FIG. 4, FIG. 15 is a sectional view of the container and of the dosing cap of FIG. 4 upon poor handling by the user after transfer of the dosed liquid into a final container, the dosing cap being open, FIG. 16 is a sectional view of the container and of a dosing cap according to the invention comprising a protection device configured to store a small amount of liquid in the flipped over position of the dosing cap, FIG. 17 is a top view of a sealing gasket with a valve that could be used as a device for regulating the dosing cap according to the invention.

Referring to FIGS. 4-6B, a dosing cap 1 according to the invention is shown, mounted on a container 30.

The container 30 is intended for the storage of products generally considered to be hazardous, in the form of liquids, such as chemicals products or phytosanitary products. In general, these liquids are stored in the container 30 in concentrated form. In order to use them for a desired application, for example the treatment of a plant, an accurate dose should be sampled therefrom, which should then be diluted, for example in water.

The container 30 is formed of a wall 31 which is tight to the liquid 40 which it contains. The wall 31 defines an inside 32 of the container 30. Moreover, the wall 31 is able to be deformed under the effect of an external pressure, for example a pressure by the hand of a user. The wall 31 is also able to recover its initial shape when the pressure exerted thereon is relieved. For example, the wall 31 may be formed of extrusion or injection of polymeric compounds such as high-density polyethylene (HDPE), polypropylene (PP), polylactic acid (PLA), polyamide (PA), polyether terephthalate (PET).

The container 30 comprises a neck 33 through which the liquid it contains could be removed out of the container 30. The neck 33 is provided with an external thread 34.

The dosing cap 1 comprises a lower ring 2 comprising an internal thread 3 able to cooperate with the external thread 34 of the neck 33 of the container 30 to mount the dosing cap 1 on the container by screwing. The lower ring 2 of the dosing cap 1 forms a means for mounting the dosing cap 1 on the neck 33, ensuring a hermetic and irreversible connection of the dosing cap 1 on the neck 33. To do so, the internal thread 3 of the lower ring 2 comprises a stop able to fit into a notch 35 located on the neck 33, fitting of the stop of the internal thread 3 of the lower ring 2 of the dosing cap 1 in the notch 35 of the neck 33 of the container 30 making unscrewing of the lower ring 2 impossible.

In an embodiment that is not represented, the lower ring could be free of any stop, so as to enable a reversible connection of the dosing cap on the neck. Such an embodiment may be suitable when the liquid contained in the container is not a dangerous product.

Referring to FIGS. 4-6B, the dosing cap 1 also comprises a dosing chamber 4. The dosing chamber 4 is intended to allow measuring and adjusting the dose of liquid 40 contained in the container for subsequent use thereof, for example in dilute form. The dosing chamber 4 comprises a lower end 5 and an upper end 6, a generally cylindrical wall 7 defining an inside 8 of the dosing chamber 4. Advantageously, the cylindrical wall 7 is transparent so as to enable the user to easily evaluate the level of liquid 40 present in the dosing chamber 4 during the process for adjusting the dose.

The cylindrical wall 7 of the dosing chamber 4 may be provided with a direct or indirect graduated scale (not shown) in order to facilitate reading of the volume level of the product that is to be dosed.

As shown in the figures, once the dosing cap 1 is mounted on the neck 33, the lower end 5 of the dosing chamber 4 faces the liquid 40 contained in the container 30. The lower end 5 of the dosing chamber 4 comprises a transverse inner wall 9 separating the inside 32 of the container from the dosing chamber 4. In the example shown in FIGS. 4-6B and 9, the inner wall 9 is provided with a valve 10.

The valve 10 is configured to prevent passage of the liquid 40 from the inside 32 of the container 30 towards the dosing chamber 4 and from the dosing chamber 4 towards the inside 32 of the container 30 when the wall 31 of the container 30 is not subjected to any stress, and to enable passage of said liquid 40 from the inside 32 of the container towards the dosing chamber 4 and from the dosing chamber 4 towards the container 30 when a pressure is applied on the wall 31 of said container 30 as it has been described hereinabove for the regulating device, in particular during the process for adjusting the dose. Thus, the transverse inner wall 9 forms a barrier to the liquid 40, the latter could nonetheless be able to pass from the inside 32 of the container towards the dosing chamber 4 or vice versa from the dosing chamber 4 towards the inside 32 of the container throughout the valve 10 when a pressure is applied on the wall 31 of the container.

For example, the valve 10 may be made of thermoplastic elastomer or silicone. For example, it may have an opening diameter ranging from about 0.5 mm to 5 cm, for example about 1 cm. The valve 10 constitutes a regulating device configured to block the passage of said liquid from the inside of the container towards the dosing chamber and from the dosing chamber towards the inside of the container under the simple effect of gravity, in the absence of stress exerted on the wall of the container, and to enable passage of the product from the inside of the container towards the dosing chamber and from the dosing chamber towards the container under the action of a determined pressure exerted on the wall of the container.

In an embodiment that is not represented, such a regulating device could be in the form of a valve combined with a vent, for example positioned laterally to the valve. Such a vent is particularly advantageous to let air pass when the liquid has a viscosity such as to make passage of both the liquid and the air within the valve alone difficult during transfer of the liquid from the inside of the container towards the dosing chamber or from the dosing chamber towards the inside of the container. For example, such a vent may have a diameter ranging from about 0.4 mm to about 1.5 mm, for example about 1 mm.

Alternatively or in combination, the regulating device may for example comprise one or several holes, formed in the wall separating the dosing chamber from the inside of the container. For example, the regulating device may comprise from 1 to 10 holes. For example, this or these hole(s) may have a diameter ranging from 0.1 to 8 mm, preferably ranging from 0.4 to 5 mm. The reduced section of such holes generates enough friction to prevent passage of the liquid from the dosing chamber towards the inside of the container and vice versa by the simple effect of gravity. On the other hand, this reduced section of these holes enables the liquid to pass from the dosing chamber towards the inside of the container and vice versa under the action of a determined pressure, for example measured and calculable, exerted on the wall of the container.

In another embodiment shown in FIG. 17, the regulating device is in the form of a sealing gasket comprising a membrane 25 ensuring sealing over its periphery 25*a*, this membrane 25 having a cutout 26, shaped as a cross with four branches 26*a* in the represented example, said cutout 26 ensuring a valve function.

As it appears from all of the figures, the dosing cap 1 according to the invention has no dipper tube. In particular, neither the inner wall 9, nor the regulating device 10 are connected to a dipper tube that would extend into the inside 32 of the container 30. Referring to FIG. 6A and to FIG. 14, the upper end 6 of the dosing chamber 4 is open. It is provided with an external thread 15 and with safety notches 18.

Referring to FIGS. 4 and 5, the dosing cap 1 comprises means for closing the upper end 6 of the dosing chamber 4, these closure means herein being in the form of an upper cover 16 comprising an internal thread 17 able to cooperate with the external thread 15 and the safety notches 18 of the upper end 6 of the dosing chamber 4 in order to form a safety device preventing unscrewing of the upper cover 16, and therefore opening of the upper end 6 of the dosing chamber 4, by children.

The means for closing the upper end 6 of the dosing chamber 4 enable reversible closure of this end 6 in order to be able to enable opening of the dosing chamber 4 towards the outside, once the liquid 40 is dosed and it is desired to transfer it into a final container for a subsequent treatment operation, for example to form a dilute solution for the treatment of a plant. These closure means also enable a hermetic closure of the upper end 6 of the dosing chamber 4.

Thus, when it is mounted closed on the neck 33 of the container 30, as shown in FIG. 5, the dosing cap 1 allows avoiding the risks of dispersion in the immediate environment of the container 30 of the liquid 40. The dosing cap 1 mounted on the container 30 forms a closed assembly free of any device that could connect the inside 8 of the dosing chamber 4 or the inside 32 of the container 30 with the outside.

Referring to FIGS. 1-9, the dosing cap 1 also comprises a protection device 20, located in the dosing chamber 4, above the valve 10. As it will appear more clearly from FIG. 15, the protection device 20 is configured to prevent portions of liquid present in a lower portion of the dosing chamber 4 from being projected beyond the upper end 6 of the dosing chamber 4 when the dosing cap 1 is open and a user inadvertently presses on the wall 31 of the container 30. To this end, the protection device 20 comprises a transverse wall portion, in the form of a circular wall 21 in the represented example, positioned distally from the opening of the valve 10, and connected to the inner wall 9 by pillars 22 which form a load-bearing structure. In the represented example, the circular wall 21 has a dimension slightly smaller than the external dimensions of the valve 10 in its closed position. Nevertheless, the circular wall 21 preferably has a dimension larger than the opening of the valve 10. In the represented example, the pillars 22 are five in number. FIGS. 10 to 12 illustrate examples of protection devices 20 comprising a different number of pillars 22: three pillars 22 for FIG. 10, four pillars 22 for FIGS. 11 and 12. The spaces between the pillars 22 define recesses 23. The recesses 23 extend distally from the inner wall 9.

The recesses 23 enable the liquid 40 passing through the valve 10 originating from the inside 32 of the container 30 to flow and fill the dosing chamber 4 during the prior dosing operations, when the upper end 6 of the dosing chamber 4 is closed. Thus, the protection device 20 enables flow of the liquid 40 from the inside 32 of the container 30 towards the dosing chamber 4, and vice versa. Moreover, the fact that the recesses 23 extend distally from the inner wall 9 of the dosing chamber 4 allows ensuring complete emptying of the dosing chamber 4 towards the inside 32 of the container 30 where appropriate.

In FIGS. 8 to 12, the pillars 22 are evenly spaced apart from one another. This allows fluidifying the flow of the liquid 40 from the inside 32 of the container 30 towards the dosing chamber 4 and vice versa.

Referring to FIG. 13, the recesses 23 are confined in a determined angular section of the periphery of the protection device 20. Such an embodiment allows ensuring that the drops of liquid which pass from the inside of the container towards the dosing chamber during the adjustment of the dose or drops of liquid likely to be projected after the phase of final transfer are confined in a specific angular section of the dosing chamber 4. It is then possible to provide graduations for assisting in dosing on the transparent wall of the dosing chamber 4 without any risk of the latter being soiled by the projected drops, by locating these graduations opposite the determined angular section in which the recesses 23 are confined.

In an embodiment represented in FIG. 16, the circular wall 21 is provided with a peripheral rim 24 extending in the proximal direction. This embodiment allows storing a small amount of liquid 40*c*, for example from 1 ml to 5 ml, which would escape from the container 30, for example because of a lack of sealing of the valve 10 or upon an erroneous handling of the container 30, when the latter is turned over, with the neck 33 directed downwards, and the upper end 6 of the dosing chamber 4 being open.

The presence of the pillars 22 (cf., for example, FIG. 11) and the peripheral rim 24 (cf. FIG. 16) enables the user who has inadvertently pressed against the container 30 with the neck 33 directed downwards to have a minimum of time to react and prevent leakage of liquid towards the external environment, by returning the container 33 upright for example. Indeed, a portion of the liquid may be retained by the peripheral rim 24 and/or diverted towards the walls of the dosing chamber 4. This is all the more true when the recesses 23 are confined as shown in FIG. 13.

The protection device 20 may be made of a material selected from among high-density polyethylene (HDPE), polypropylene (PP), polylactic acid (PLA), polyamide (PA), polyether terephthalate (PET), and mixtures thereof.

The protection device 20, like the container 30 and all of the parts forming the dosing cap 1, may for example be made of high-density polyethylene (HDPE). Such a material has flexibility and natural resistance to chemicals. Moreover, this material can be treated by fluorination. This surface treatment allows increasing the natural barrier properties of polyethylene. Such a treatment contributes to reducing the risks of migration of the liquid 40, or of its vapors, from the inside of the container 30 or of the dosing chamber 4, towards the outside.

FIG. 15 illustrates the container 30 and the dosing cap 1 of FIG. 6B when the dose of liquid 40, which has been adjusted beforehand within the dosing chamber 4, has been transferred into a final container (not represented). In order to perform transfer of this dose, as described hereinabove, the upper cover 16 has been removed and the upper end 6 of the dosing chamber 4 is open. Once the dose of liquid transferred into the final container, the user places the container 30 standing on a planar surface, the neck 33 upwards. It might then happen that the user inadvertently presses on the wall 31 of the container 30 before having had the time to close the upper end 6 of the dosing chamber 4: this is what is represented by the arrows P in FIG. 15. In such a case, the pressure differential between the inside 32 of the container 30 and the inside 8 of the dosing chamber 4, related in the represented example to the great deformability of the elastomer valve 10, causes the sudden opening of this valve 10. Drops of liquid that were present in the lower portion of the dosing chamber, for example at the level of the lower end 5 of the dosing chamber 4, or that were present on the valve 10, could then be projected towards the upper portion of the dosing chamber 4, while the upper end 6 of the latter is open.

As shown in FIG. 15, in such a situation, the protection device 20 of the dosing cap 1 according to the invention allows avoiding such drops of liquid being able to be projected towards the user or its environment. Indeed, thanks to the presence of the circular wall 21, positioned distally from the valve 10 and upon opening of the latter, the drops of liquid projected in the distal direction, such as the drop 40*b* shown in FIG. 15, are stopped by the circular wall 21 and are prevented from reaching the upper end 6 of the dosing chamber 4. Moreover, among the drops of liquid that are projected according to a direction forming an angle with the distal direction, some of them will be stopped directly in their travel by the pillars 22, and those that will pass throughout the recesses 23 will be stopped by the cylindrical wall 7 of the dosing chamber 4 well before reaching the upper end of the latter, like the drop 40*a* of FIG. 15.

Thus, thanks to the protection device 20 of the dosing cap 1 according to the invention, a poor handling of the container 30 after the phase of transfer of the dosed liquid into the final container does not lead to any risk of drops of liquids being projected beyond the dosing chamber and towards the user and its environment as might be the case with a container provided with a conventional dosing cap as shown in FIG. 3.

Thus, the final phase of transfer of the dosed liquid is perfectly safe with the dosing cap 1 according to the invention.

Thus, the dosing cap according to the invention allows performing the accurate dosing of a liquid, in particular a concentrated liquid, without any risk of contact with the user when this dosing cap is hermetically closed, and at the same time avoiding any risk of contact with the user and its environment in situations where this dosing cap is open.

The invention claimed is:

1. A dosing cap with no dipper tube, configured to be mounted on the neck of a container formed of a wall able to be deformed under the effect of an external pressure, said wall defining an inside of said container, in which a liquid is contained, said dosing cap comprising:

means for mounting the dosing cap to said neck, said mounting means being configured to ensure a hermetic connection of the dosing cap to the neck, a dosing chamber comprising a lower end and an upper end, said lower end being configured to be arranged opposite the liquid contained inside said container when the dosing cap is mounted on said neck, said lower end comprising an inner wall separating the dosing chamber from the inside of the container, said inner wall being provided with a regulating device configured to block the passage of said liquid from the inside of the container towards the dosing chamber and from the dosing chamber towards the inside of the container under the simple effect of gravity, in the absence of any stress exerted on the wall of the container, and to enable passage of the liquid and gas from the inside of the container towards the dosing chamber and from the dosing chamber towards the container under the action of a determined pressure exerted on the wall of the container, said upper end being open, means for closing the upper end of the dosing chamber, adapted to be removably fastened on said upper end and configured to ensure a hermetic closure of said upper end with respect to the external environment when fastened on said upper end, said dosing cap further comprises:

a protection device located in the dosing chamber above the regulating device, said protection device being configured to prevent liquid portions originating from a lower portion of the dosing chamber or of the regulating device from being projected, under the action of a pressure exerted on the wall of the container in the absence of the closure means of the upper end of the dosing chamber, beyond said upper end of the dosing chamber.

2. The dosing cap according to claim 1, wherein the protection device comprises a transverse wall portion, located opposite the regulating device and distally with respect to the regulating device, and a load-bearing structure connecting said transverse wall portion to said inner wall, said load-bearing structure comprising at least one recess.

3. The dosing cap according to claim 2, wherein said load-bearing structure comprises a plurality of recesses, said recesses being separated from one another by a plurality of pillars extending from said transverse wall portion to said inner wall, distributed along the perimeter of said transverse wall portion.

4. The dosing cap according to claim 3, wherein said recesses and said pillars are evenly spaced along the perimeter of said transverse wall portion.

5. The dosing cap according to claim 2, wherein said recess(es) is/are confined in a determined angular section of the periphery of the load-bearing structure.

6. The dosing cap according to claim 5, wherein the dosing chamber is delimited by a transparent or translucent cylindrical wall provided with graduations for assisting in dosing.

7. The dosing cap according to claim 6, wherein said graduations are located in an angular section of the transparent or translucent cylindrical wall diametrically opposite to said determined angular section.

8. The dosing cap according to claim 2, wherein said transverse wall portion is provided with a proximal peripheral rim able to contain said amount of liquid on a proximal face of said transverse wall portion.

9. The dosing cap according to claim 2, wherein at least one of said recesses extends distally from said inner wall.

10. The dosing cap according to claim 1, wherein said protection device is configured to store an amount of liquid ranging from 1 ml to 5 ml in a flipped over position of the dosing cap.

11. The dosing cap according to claim 1, wherein said regulating device comprises an elastomeric valve.

12. The dosing cap according to claim 1, wherein said regulating device comprises one or several hole(s) having a diameter ranging from 0.1 to 8 mm, formed in the inner wall separating the dosing chamber from the interior of the container.

13. The dosing cap according to claim 1, wherein the regulating device comprises a sealing gasket equipped with a valve system.

14. The dosing cap according to claim 1, wherein the mounting means are configured to ensure an irreversible connection of the dosing cap to the neck.

15. A container comprising a neck and formed of a wall able to be deformed under the effect of an external pressure, said wall defining an inside of said container, in which a liquid is contained, wherein the dosing cap according to claim 1 is mounted on said neck according to a hermetic connection, by means of said mounting means.

* * * * *